US007223217B1

(12) United States Patent
Liao

(10) Patent No.: US 7,223,217 B1
(45) Date of Patent: May 29, 2007

(54) MULTIFUNCTION EXERCISER

(76) Inventor: Chung-San Liao, No. 133, Wucuo Li, Siluo Chen, Yunlin Hsien (TW)

( * ) Notice: Subject to any disclaimer, the term of this patent is extended or adjusted under 35 U.S.C. 154(b) by 0 days.

(21) Appl. No.: 11/406,996

(22) Filed: Apr. 18, 2006

(51) Int. Cl.
*A63B 21/02* (2006.01)
*A63B 21/05* (2006.01)

(52) U.S. Cl. ..... 482/122; 482/125; 482/128

(58) Field of Classification Search ..... 482/49, 482/55, 121, 122, 124–126, 128, 131; 5/648; 602/24; 128/882; D21/684, 692–3
See application file for complete search history.

(56) References Cited

U.S. PATENT DOCUMENTS 4,830,366 A * 5/1989 Ruden ..... 482/124
4,842,273 A * 6/1989 Schmeiss ..... 482/49
4,909,506 A * 3/1990 Smith ..... 482/124
5,397,288 A * 3/1995 Sayre ..... 482/125
5,674,164 A * 10/1997 Kravitz ..... 482/126
5,697,873 A * 12/1997 Van Straaten ..... 482/126
5,911,535 A * 6/1999 Gvoich ..... 482/124
6,110,082 A * 8/2000 Tsai ..... 482/121
6,179,756 B1 * 1/2001 Bertolucci et al. ..... 482/91
7,041,041 B1 * 5/2006 Evans ..... 482/126
2006/0217248 A1 * 9/2006 Diseati ..... 482/128

* cited by examiner

*Primary Examiner*—Allana Lewin
(74) *Attorney, Agent, or Firm*—Pai Patent & Trademark Law Firm; Chao-Chang David Pai

(57) ABSTRACT

An exerciser includes a safety block having two through holes defined through the safety block and two cutouts defined in two opposite sides of the safety block, two elastic strings respectively extending through and securely received the two through holes of the safety block, two safety pads each provided to opposite sides of the safety block to securely connect to one end of the two elastic to allow an operator to work on thigh muscles and two rings connected to a corresponding one of the two safety pads to allow the operator to work on chest muscles.

12 Claims, 6 Drawing Sheets

MULTIFUNCTION EXERCISER

BACKGROUND OF THE INVENTION

1. Field of the Invention

The present invention relates to an exerciser, and more particularly to an exerciser designed to work out the operator's muscles in the thigh, the chest and the arms.

2. Description of the Prior Art

The purpose of going to the fitness centers is to work on the body figure or to increase the muscle endurance. Therefore, the biggest advantage of the fitness center is that it has various equipment so that the fitness-center-goer can choose whatever the equipment to work on the specific body part. However, to those who can not go to the fitness center to work on the body, buying himself/herself a simple exerciser seems to be the only option. With the simplified exerciser, the operator is able to work on the designated muscles. However, after a period of time using the same exerciser to work on the same body part, the operator's figure may be out of shape. Not because the operator is lazy and does no exercise, but because the operator keeps on working the same body part, which neglects the importance of working the other portions of the body to keep the body fit. To solve the problem, buying more different exercises may seem the key to maintain the body in shape. But the concern of financial burden to the operator arises.

To overcome the shortcomings, the present invention tends to provide an improved multifunctional exerciser to mitigate the aforementioned problems.

SUMMARY OF THE INVENTION

The primary objective of the present invention is to provide a multifunctional exerciser to allow the operator to have options to build on muscles on the designated body part.

In order to accomplish the objective, the exerciser of the present invention includes a safety block, two elastic strings respectively extending through the safety block, two safety pads respectively provided on opposite sides of the safety block to securely connected to two ends of each of the two elastic strings and two rings respectively having two ends to be securely connected to a corresponding one of the two safety pads. Therefore, the operator is able to use the recovery force of the two elastic strings to work on the muscles on the chest with the rings attached to the safety pads. Also, the operator may also work on the muscles on the arms with one of the rings removed. Still the operator is able to work on the muscles on the thighs with both rings removed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
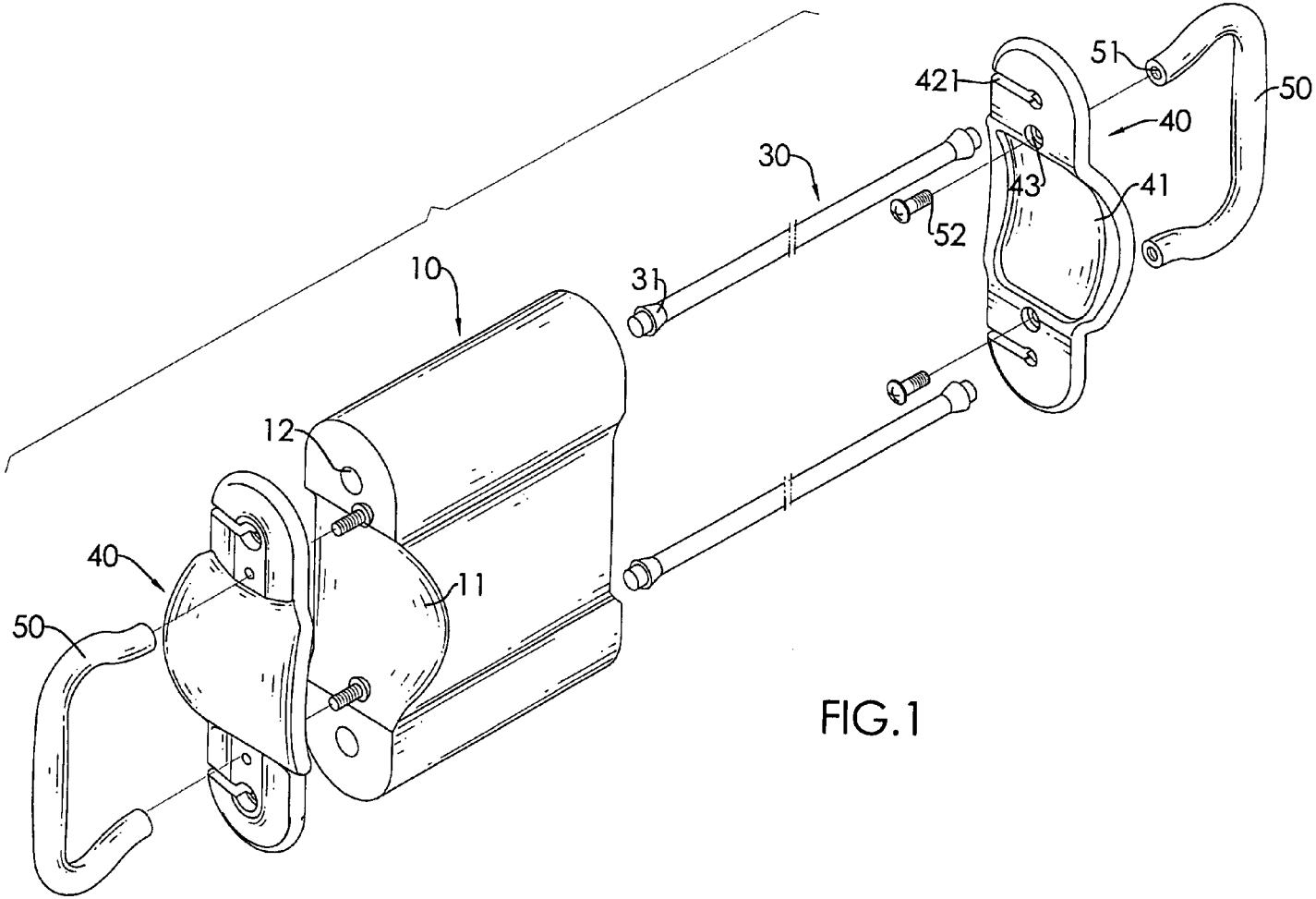
FIG. 1 is an exploded perspective view of the exerciser of the present invention.

With reference to FIG. 1, it is noted that the exerciser in accordance with the present invention includes a safety block (10), two elastic strings (30), two safety pads (40) and two rings (50).

The safety block (10) is made of rubber and has two arcuate cutouts (11) defined respectively in opposite sides of the safety block (10) and two through holes (12) defined through the safety bock (10).

Each elastic string (30) is made of an elastic material and has a conical head (31) formed on two ends thereof. Each of the safety pads (40) is made of rubber and has an arcuate recess (41) defined to correspond to the arcuate cutout (11), two positioning holes (42) defined in the safety pad (40) and being away from each other with the arcuate recess (41) situated therebetween, two paths (421) each defined to communicate with a corresponding one of the positioning holes (42) to allow the positioning hole (42) to communicate with the ambient air and screw holes (43) each defined adjacent to a corresponding one of the positioning holes (42).

Each ring (50) has a substantially U shaped cross section and securing holes (51) defined in two ends of the ring (50) to correspond to the screw holes (43) of the safety pad (40).

Figure 2:
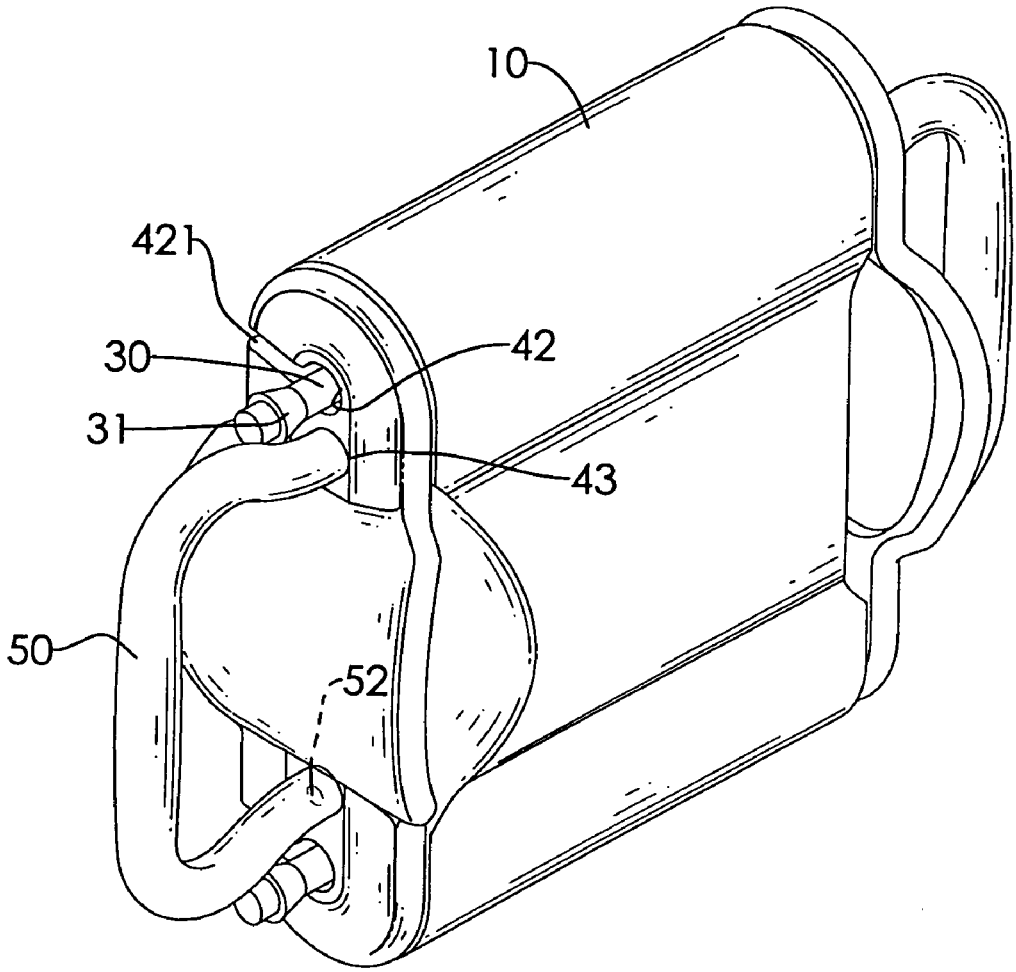
FIG. 2 is a perspective view of the exerciser in assembly.

With reference to FIGS. 1 and 2, when the exerciser of the present invention is assembled, it is noted that the two elastic strings (30) are extended through the two through holes (12) of the safety block (10) respectively. Because the head (31) has a diameter larger than a diameter of the through hole (12), after the two elastic strings (30) are extended through the two through holes (12), the two elastic strings (30) are secured inside the two through holes (12). Then the two elastic strings (30) slides through the paths (421) of the safety pads (40) and use the heads (31) to abut a periphery defining the positioning holes (42). Similarly, because the head (31) has a diameter larger than a diameter of the positioning holes (42), the two elastic strings (30) are secured inside the two positioning holes (42). Furthermore, after alignment between the two screw holes (43) and the two securing holes (51) of each ring (50) is finished, a securing element (52), e.g. a screw, is able to extend into the aligned screw holes (43) and the securing holes (51) of each of the two rings (50) to secure engagement between the rings (50) and the safety pads (40).

Figure 3:
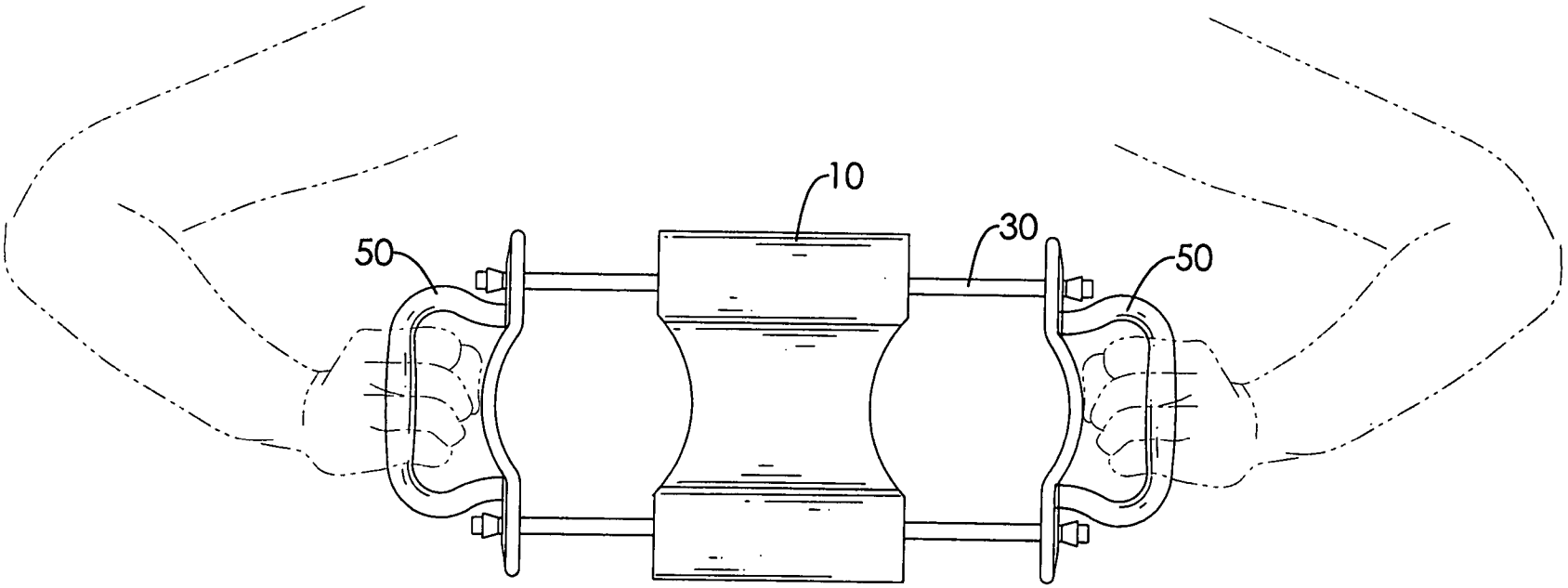
FIG. 3 is a first operational view of the exerciser of the present invention.

With reference to FIG. 3, when the two rings (50) are attached to the two safety pads (40) respectively, the operator is able to hold the two rings (50) and work on the muscles on the chest by the recovery force of the two elastic strings (30).

Figure 4:
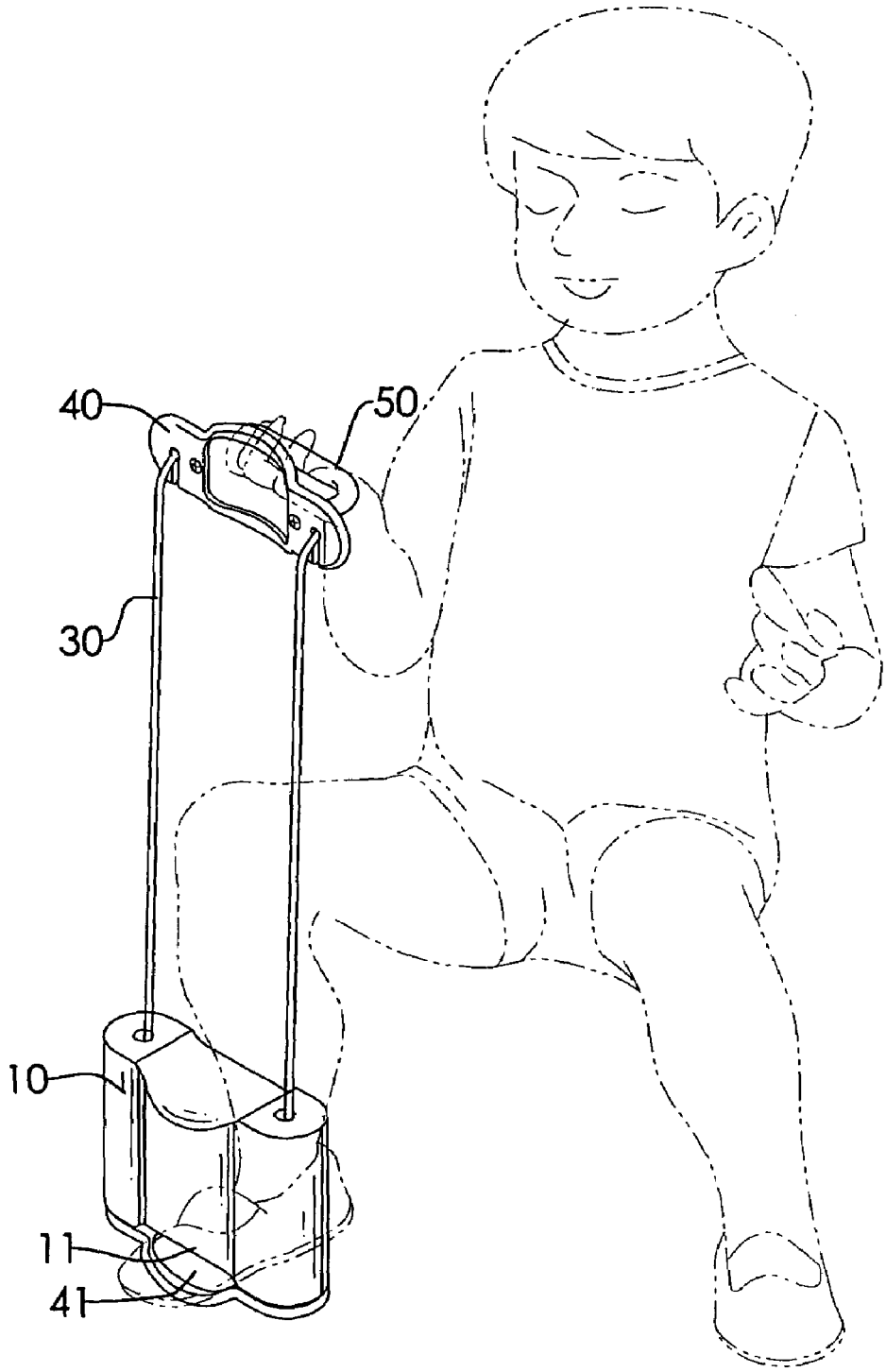
FIG. 4 is a second operational view of the exerciser of the present invention.

With reference to FIG. 4, when one of the rings (50) is removed from the corresponding safety pad (40), the operator is able to use the toe to extend into a space between the cutout (10) and the arcuate recess (41) and hold the remaining ring (50) with one arm, such that the operator is able to work on the muscles on the arms.

Figure 5:
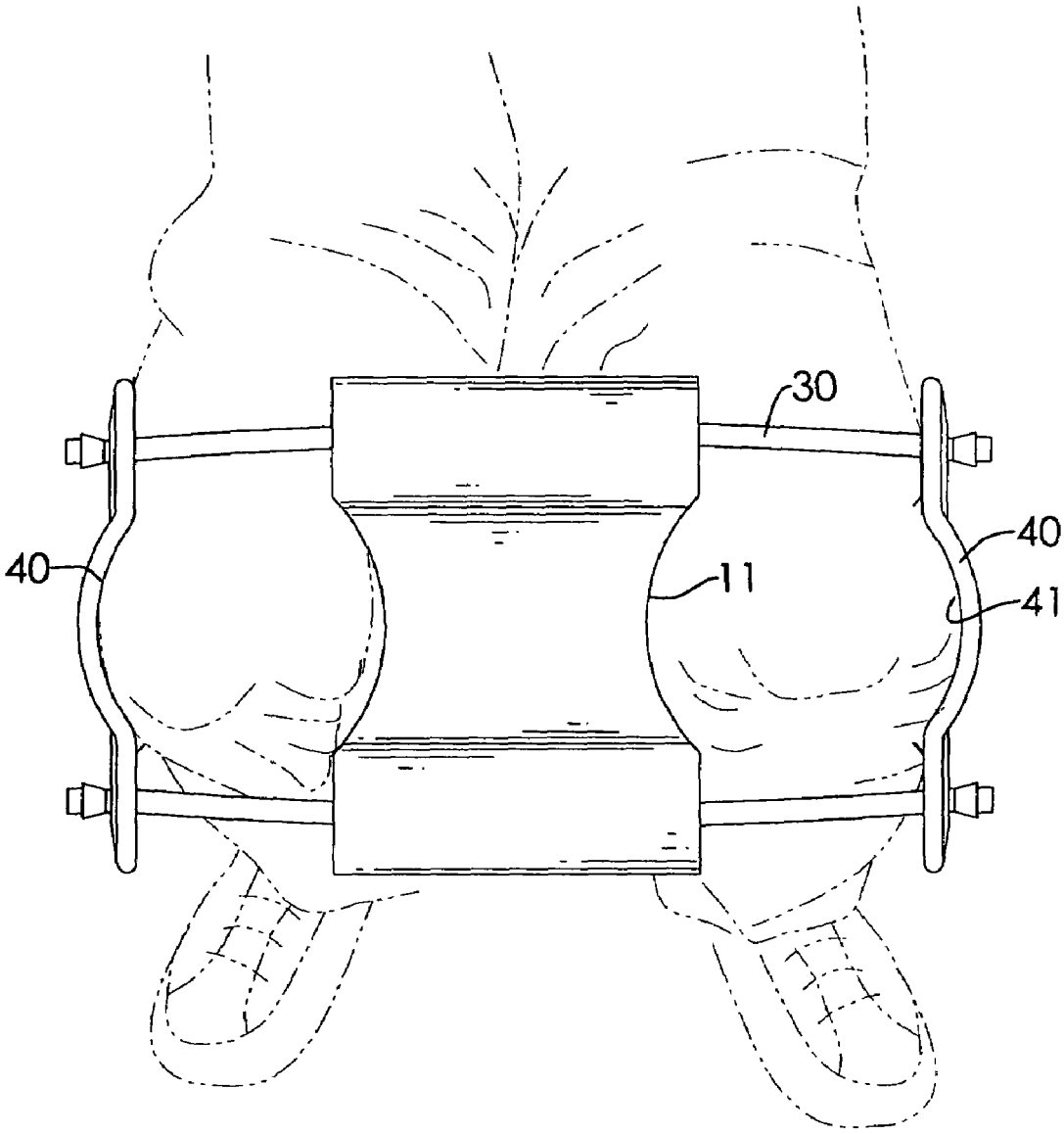
FIG. 5 is a third operational view of the exerciser of the present invention.
Figure 6:
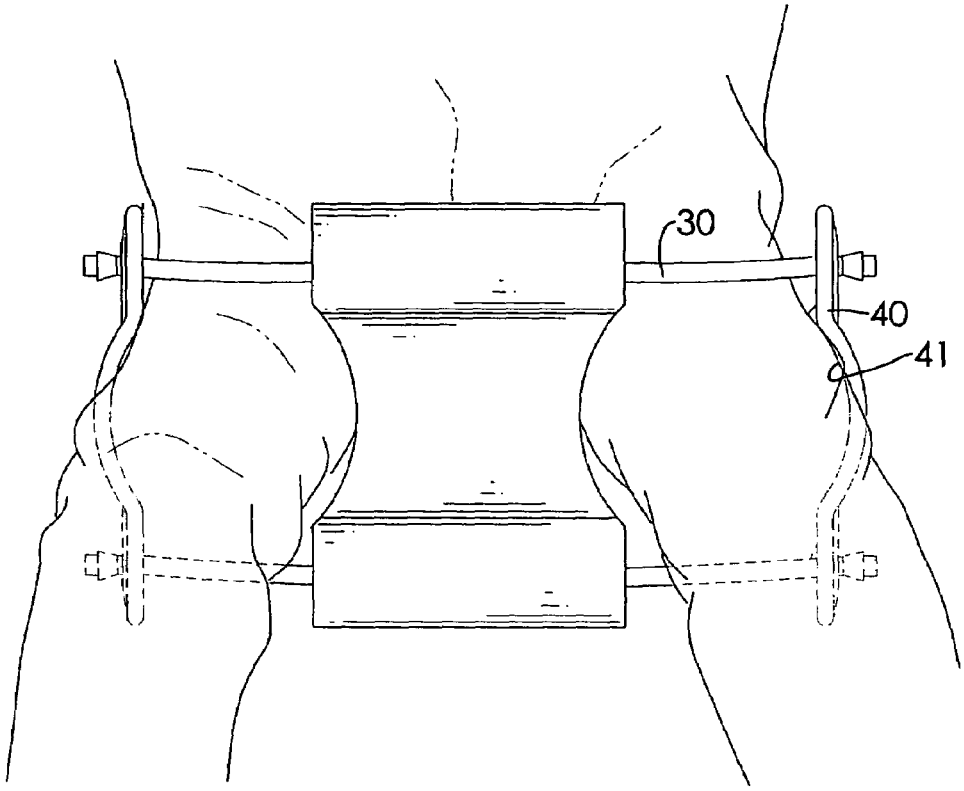
FIG. 6 is a fourth operational view of the exerciser of the present invention.

With reference to FIGS. 5 and 6, when both rings (50) are removed, the operator may extend both knees (or the entire legs) into the spaces between the arcuate recess (41) and the cutout (11) and work on the muscles on the thighs.

Accordingly, it is noted that with the exerciser of the present invention, the operator may be able to work on muscles of different body parts to achieve the objective of maintaining the body in great shape.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exerciser comprising:

a safety block made of rubber and having two through holes defined through the safety block and two cutouts defined in two opposite sides of the safety block;

two elastic strings, each having a first end and a second end, respectively extending through and securely received in a corresponding one of the two through holes of the safety block; and two safety pads each having a first side and a second side and each provided to opposite sides of the safety block to securely connect to one end of the two elastic strings and each pad having an arcuate recess defined to correspond to one of the cutouts on each side of the safety block to define therebetween a space to allow an operator to work on thigh muscles by recovery force of the two elastic strings when two knees are respectively extended through each of the spaces between the safety blocks and the safety pads.

2. The exerciser as claimed in claim 1, wherein each safety pad has two positioning holes defined to securely receive therein a head which is formed on ends of each of the two elastic strings, each head has a diameter larger than a diameter of the positioning hole so that after the head is received in the positioning holes, engagement between the two elastic strings and the two safety pads is secured.

3. The exerciser as claimed in claim 2, wherein each safety pad further has two paths respectively defined to correspond to one of the two positioning holes to allow the two positioning holes to communicate with ambient air so that the two elastic strings are able to be received in the corresponding positioning holes by sliding through the paths.

4. The exerciser as claimed in claim 1 further having a first ring securely attached to one side of a corresponding one of the two safety pads such that the operator is able to work on muscles on the arms with the recovery force of the two elastic strings by stepping on one of the safety pads and holding the ring.

5. The exerciser as claimed in claim 2 further having a first ring securely attached to one side of a corresponding one of the two safety pads such that the operator is able to work on muscles on the arms with the recovery force of the two elastic strings by stepping on one of the safety pads and holding the ring.

6. The exerciser as claimed in claim 3 further having a first ring securely attached to one side of a corresponding one of the two safety pads such that the operator is able to work on muscles on the arms with the recovery force of the two elastic strings by stepping on one of the safety pads and holding the ring.

7. The exerciser as claimed in claim 4 further having a second ring securely attached to the other side of a corresponding one of the two safety pads such that the operator is able to work on muscles on the chest with the recovery force of the two elastic strings by holding the first and the second rings.

8. The exerciser as claimed in claim 5 further having a second ring securely attached to the other side of a corresponding one of the two safety pads such that the operator is able to work on muscles on the chest with the recovery force of the two elastic strings by holding the first and the second rings.

9. The exerciser as claimed in claim 6 further having a second ring securely attached to the other side of a corresponding one of the two safety pads such that the operator is able to work on muscles on the chest with the recovery force of the two elastic strings by holding the first and the second rings.

10. The exerciser as claimed in claim 7, wherein the safety pad further has screw holes defined to align with securing holes defined in two ends of each of the first ring and the second ring so that a securing element is able to extend into the aligned screw holes and the securing holes to secure engagement between the rings and the safety pads.

11. The exerciser as claimed in claim 8, wherein the safety pad further has screw holes defined to align with securing holes defined in two ends of each of the first ring and the second ring so that a securing element is able to extend into the aligned screw holes and the securing holes to secure engagement between the rings and the safety pads.

12. The exerciser as claimed in claim 9, wherein the safety pad further has screw holes defined to align with securing holes defined in two ends of each of the first ring and the second ring so that a securing element is able to extend into the aligned screw holes and the securing holes to secure engagement between the rings and the safety pads.

* * * * *